US007234839B2

(12) United States Patent
Cheng

(10) Patent No.: US 7,234,839 B2
(45) Date of Patent: Jun. 26, 2007

(54) LIGHTING DEVICE FOR FESTIVAL DECORATION

(76) Inventor: Hon Kwok Cheng, Unit 811, 8/F, Tower 1, Harbour Centre, 1 Hok Cheung Street, Hung Hom, Kowloon (HK)

( * ) Notice: Subject to any disclaimer, the term of this patent is extended or adjusted under 35 U.S.C. 154(b) by 136 days.

(21) Appl. No.: 11/130,145

(22) Filed: May 17, 2005

(65) Prior Publication Data

US 2006/0232968 A1 Oct. 19, 2006

(30) Foreign Application Priority Data

Apr. 13, 2005 (CN) ..... 2005 2 0011753

(51) Int. Cl.
*F21V 21/00* (2006.01)

(52) U.S. Cl. ..... 362/249; 362/250; 362/251; 362/431; 362/391; 362/806; 362/396

(58) Field of Classification Search ..... 362/431, 362/249, 391, 806, 351, 250, 396, 287, 427, 362/251; 315/185 R, 185 S, 291, 195, DIG. 4
See application file for complete search history.

(56) References Cited

U.S. PATENT DOCUMENTS 5,323,088 A * 6/1994 Cunningham ..... 315/195
5,420,482 A * 5/1995 Phares ..... 315/292
5,957,564 A * 9/1999 Bruce et al. ..... 362/84
6,086,221 A * 7/2000 Wu ..... 362/249
6,827,466 B2 * 12/2004 Tsai ..... 362/231
6,966,680 B2 * 11/2005 Kratz ..... 362/431
7,026,768 B1 * 4/2006 Ruiz ..... 315/185 R
2004/0075401 A1 * 4/2004 Segan et al. ..... 315/291
2005/0179400 A1 * 8/2005 Janning ..... 315/185 S
2005/0225976 A1 * 10/2005 Zampini et al. ..... 362/227
2006/0082987 A1 * 4/2006 Dorsey et al. ..... 362/103

* cited by examiner

*Primary Examiner*—Thomas M. Sember
(74) *Attorney, Agent, or Firm*—Rabin & Berdo, P.C.

(57) ABSTRACT

A lighting device for festival decoration comprises a plurality of decorative lamp blocks wired in series successively, each block having a two-row lamp fixture; a lamplight controller and a knob switch for regulating lamplights electrically coupled with the wired decorative lamp blocks. The decorative lamp block consists of two-row lampshades, a box body and a lamp body. According to the invention, the lighting device for festival decoration comprises a plurality of decorative lamp blocks having two-row decorative lamps controlled by the lamplight controller, wherein each block is electrically connected for an equal period of time and started up at a different point of time, so that the decorative lamp blocks are powered on successively to give out special run-after lighting effects at a run-after speed regulated by the knob switch.

14 Claims, 4 Drawing Sheets

LIGHTING DEVICE FOR FESTIVAL DECORATION

FIELD OF THE INVENTION

The present invention relates to a lighting device for generating decorative effects.

BACKGROUND OF THE INVENTION

A wide variety of decorative lights are currently available, among which the lamp strings simply assembled for decorating front doors of the bars and/or restaurants are most commonly used. In some cases, tube lamps arranged on a roof give out magic run-after lighting effects for decorating environments. Being short of variations in the tube lamp category, people often strength the decorative effects by changing the winding shapes of the tube lamps. However, these changes are not easy to produce a wonderful visual effect. In general, illuminating lamps disposed on a garden lawn for decorative purposes are structurally complicated and manufacturally expensive and unable to display a decorative effect that two-row lights run after simultaneously.

SUMMARY OF THE INVENTION

It is an object of the present invention to provide a lighting device for festival decoration for marvelously decorative purposes and for generating two-row light run-after effects. It has advantages of being simple and novel in structure, cheap in cost, convenient to install in situ, high in stability and producing specialized lighting effects.

In order to accomplish the aforesaid object, there is provided a lighting device for festival decoration comprising a plurality of decorative lamp blocks wired in series successively, each block having a two-row lamp fixture; a lamplight controller and a lamplight regulating knob switch electrically coupled with the wired decorative lamp blocks.

In another embodiment of the invention, the lighting device for festival decoration is further electrically coupled with an illumination decorative lamphouse.

In a further embodiment of the invention, the decorative lamp block consists of two-row lampshades, a box body and a lamp body, wherein the two-row lampshades are secured to both sides of the box body and movably connected with the box body.

Preferably, a mounting support is provided on the underside of the box body to allow the box body to be easily placed.

Further preferably, the mounting support is fitted with a base.

In accordance with the invention, the lighting device for festival decoration further comprises a circuit arrangement including a IC controller, lamplight regulating circuits, an output circuit, luminescent lamps and a power-supply circuit, wherein the IC controller has an input terminal connected to the lamplight regulating circuits, an output terminal connected to the luminescent lamps via the output circuit; the IC controller, the lamplight regulating circuits, the output circuit and the luminescent lamps are powered by being connected individually to the power-supply circuit.

The lamplight regulating circuit may be a regulable knob switch for regulating the run-after speed of lamplights irradiated from the lighting device. The IC controller is designed to control the different blocks to be powered on for an equal period of time and to be started up at different delay times, thus generating run-after lighting effects.

When compared with the existing decorative lamp strings, the lighting device for festival decoration according to the invention comprises a plurality of decorative lamp blocks having two-row decorative lamps controlled by the lamplight controller, wherein each block is electrically connected for an equal period of time and started up at a different point of time, so that the decorative lamp blocks are powered on successively to give out special run-after lighting effects. The run-after speed may be regulated by the knob switch. When arranged on a garden, a lawn, a walkway or a roof, the invented lighting device for festival decoration will generate specialized lighting effects that are new, eye-catching and stylistic.

The invention will now be described in more detail with reference to the accompanying drawings.

DETAILED DESCRIPTION OF THE INVENTION

Figure 1:
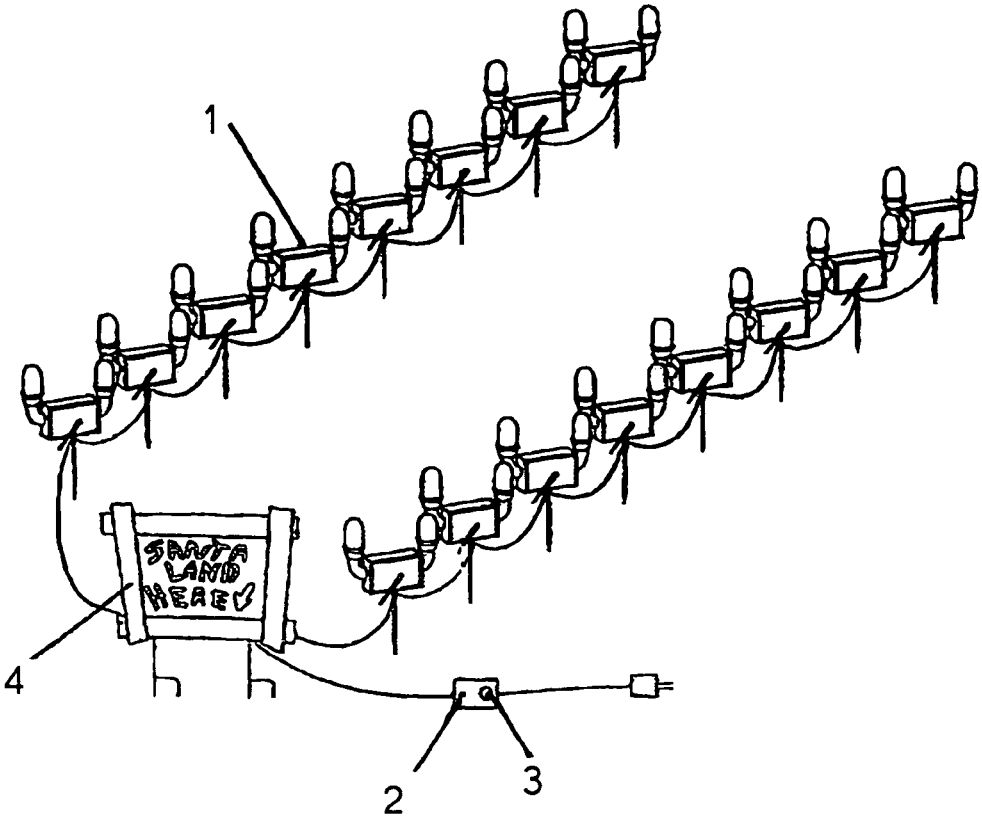
FIG. 1 is a diagrammatical view showing a lighting device for festival decoration of a preferred embodiment according to the invention.
Figure 2:
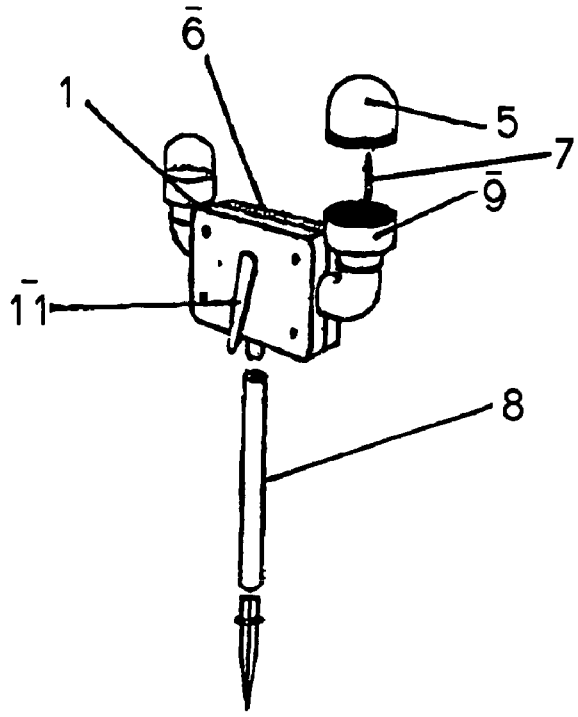
FIG. 2 is a schematic diagram showing a single decorative lamp block of the lighting device for festival decoration according to the invention.
Figure 3:
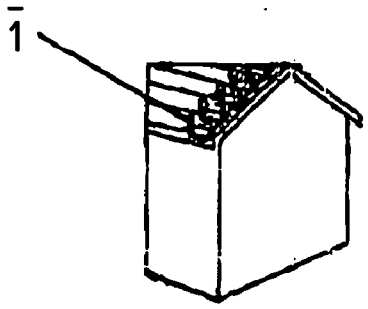
FIG. 3 is a schematic diagram showing the lighting device for festival decoration arranged on a roof in its use state.

Referring now to FIGS. 1 to 3, one preferred lighting device for festival decoration is shown in FIG. 1, which comprises a plurality of decorative lamp blocks 1 wired in series successively, each block 1 having a two-row lamp fixture; a lamplight controller 2 and a lamplight regulating knob switch 3 electrically coupled with the wired decorative lamp blocks 1. The lighting device for festival decoration is further electrically coupled with an illumination decorative lamphouse 4. The decorative lamp block 1 consists of two-row lampshades 5, a box body 6 and a lamp body 7, wherein the two-row lampshades 5 are secured to both sides of the box body 6 and movably connected with the box body 6. A mounting support 8 is movably provided on the underside of the box body 6 to make it possible for the box body to be conveniently placed on the lawn. The box body 6 may also be fitted with a base to allow it to be easily put on the ground.

The mounting support 8 may be connected with the box body 6 in a movable manner, or they are made integrally. The lampshades 5 are attached to both sides of the box body 6 by means of a base 9 to which said box body is movably connected.

For the purpose of being easy to install, a hook member 11 is movably attached to at least one side of the box body 6 for application to various situations.

In accordance with the invention, the number of the blocks is between 5 and 8 in most cases.

Figure 4:
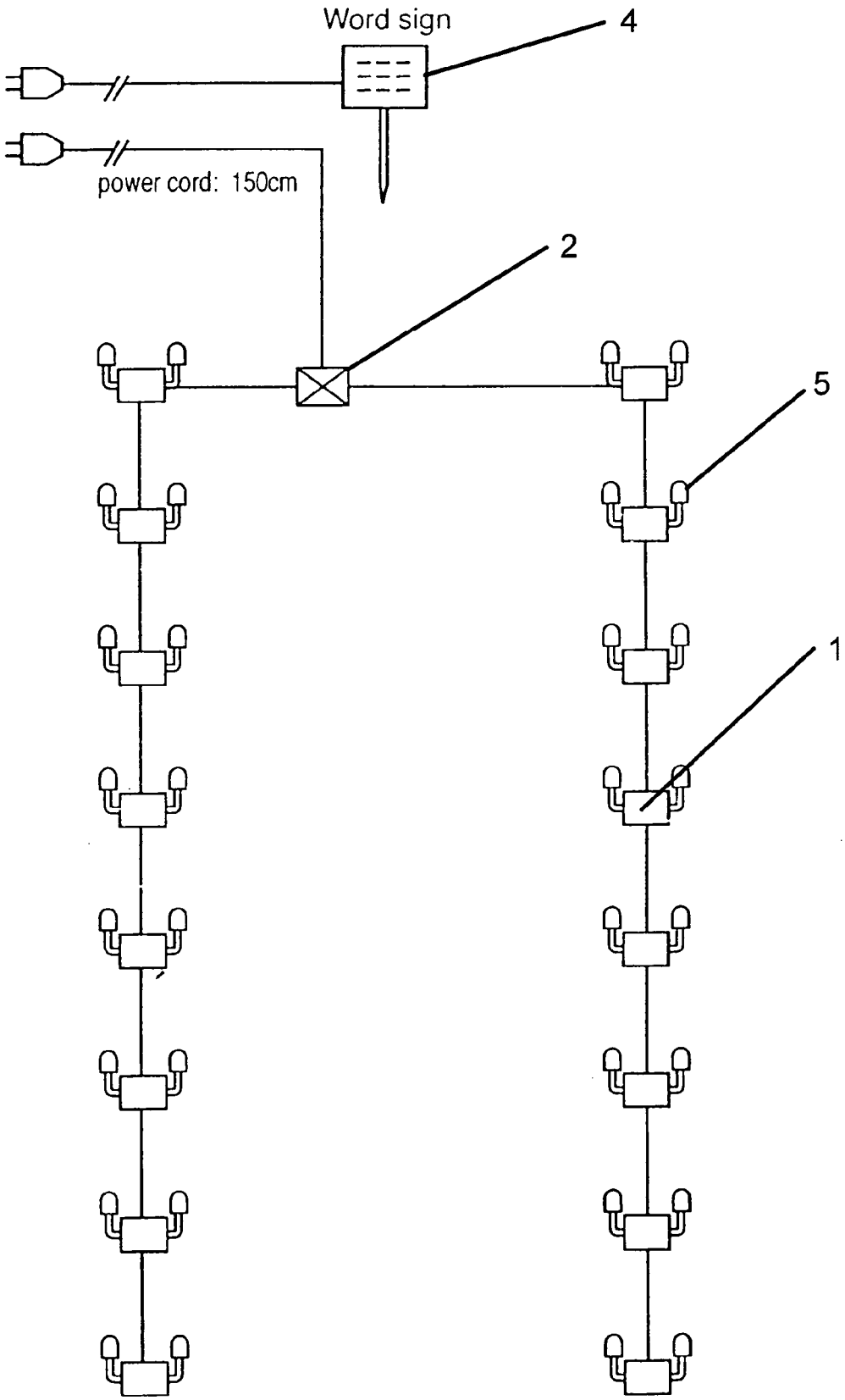
FIG. 4 is a schematic diagram showing a electrical connection of the lighting device for festival decoration according to the invention.
Figure 5:
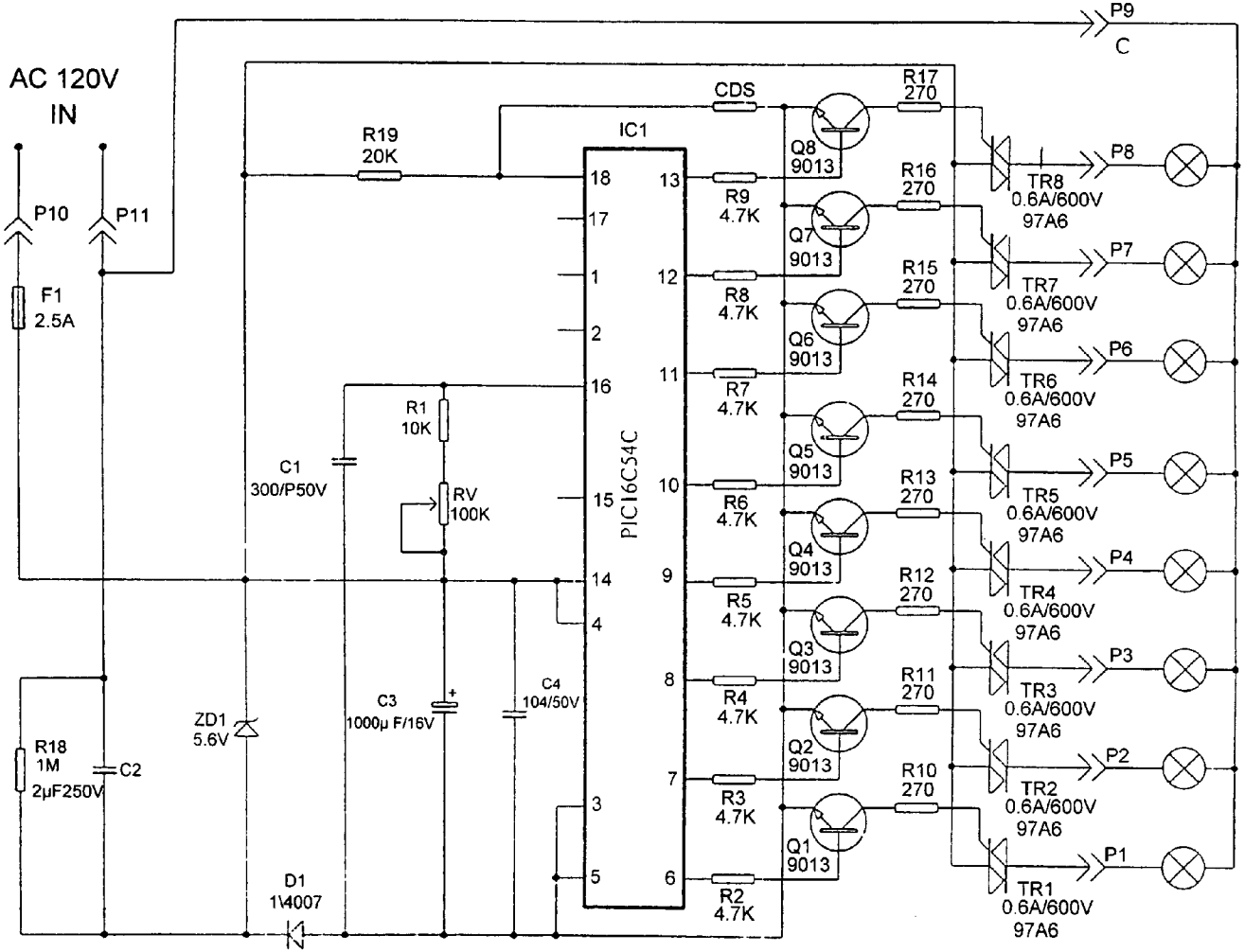
FIG. 5 is a schematic diagram showing a control principle of the lighting device for festival decoration according to the invention.

Referring now to FIGS. 4 and 5, a circuit arrangement of the lighting device for festival decoration includes a IC controller IC1, lamplight regulating circuits R1, RV, an output circuit, luminescent lamps and a power-supply circuit, wherein the IC controller has an input terminal connected to the lamplight regulating circuits, an output terminal connected to the luminescent lamps via the output circuit which is made up of switching tubes Q1-Q8 coupled together with bidirectional transistors TR1-TR8; the IC controller, the lamplight regulating circuits, the output circuit and the luminescent lamps are powered by being connected individually to the power-supply circuit. In operation, the power of 120 VAC is employed. When the IC controller produces outputs, it is electrically connected with the output circuit to turn on the luminescent lamps, when there is no output, it turns off the power supply of the luminescent lamps. For the luminescent lamps, both the power-on time and the start-up delay time are set up in the controller.

When used, the controller may control a plurality of the decorative lamp blocks to operate at a run-after speed which may be regulated by the knob switch in the lamplight regulating circuit.

The lamp fixtures according to the invention may be made of injection molded parts, characterized by low cost, easy installation and diversification of products.

Numerous variations and modifications are easily obtainable by means of the skilled person's common knowledge without departing from the scope of the invention, however, such variations and modifications should fall into the scope of this invention.

What is claimed is:

1. A lighting device for festival decoration, comprising:

a plurality of decorative lamp blocks wired in series successively, each block having a two-row lamp fixture, each decorative lamp block including two-row lampshades, a box body, a hook movably attached to at least one side of the box body, and a lamp body, wherein the two-row lampshades are secured to both sides of the box body and movably connected with the box body; and a lamplight controller and a lamplight regulating knob switch, electrically coupled with the wired decorative lamp blocks.

2. The lighting device for festival decoration as claimed in claim 1, further comprising an illumination decorative lamphouse electrically coupled with the a lamplight controller.

3. The lighting device for festival decoration as claimed in claim 2, wherein a mounting support is provided on the underside of said box body to allow the box body to be easily placed.

4. The lighting device for festival decoration as claimed in claim 3, wherein said box body is fitted with a base.

5. The lighting device for festival decoration as claimed in claim 3, wherein said mounting support is movably connected to said box body.

6. The lighting device for festival decoration as claimed in claim 2, wherein the lampshades are attached to both sides of the box body by means of the base to which said box body is movably connected.

7. The lighting device for festival decoration as claimed in claim 2, further comprising a circuit arrangement including a IC controller, lamplight regulating circuits, an output circuit, luminescent lamps and a power-supply circuit, wherein the IC controller has an input terminal connected to the lamplight regulating circuits, an output terminal connected to the luminescent lamps via the output circuit; and wherein the IC controller, the lamplight regulating circuits, the output circuit and the luminescent lamps are powered by being connected individually to the power-supply circuit.

8. The lighting device for festival decoration as claimed in claim 7, wherein said output circuit is made up of switching tubes coupled together with bidirectional transistors.

9. The lighting device for festival decoration as claimed in claim 1, wherein a mounting support is provided on the underside of said box body to allow the box body to be easily placed.

10. The lighting device for festival decoration as claimed in claim 9, wherein said box body is fitted with a base.

11. The lighting device for festival decoration as claimed in claim 9, wherein said mounting support is movably connected to said box body.

12. The lighting device for festival decoration as claimed in claim 1, wherein the lampshades are attached to both sides of the box body by means of the base to which said box body is movably connected.

13. The lighting device for festival decoration as claimed in claim 1, further comprising a circuit arrangement including a IC controller, lamplight regulating circuits, an output circuit, luminescent lamps and a power-supply circuit, wherein the IC controller has an input terminal connected to the lamplight regulating circuits, an output terminal connected to the luminescent lamps via the output circuit; the IC controller, and wherein the lamplight regulating circuits, the output circuit and the luminescent lamps are powered by being connected individually to the power-supply circuit.

14. The lighting device for festival decoration as claimed in claim 13, wherein said output circuit is made up of switching tubes coupled together with bidirectional transistors.

* * * * *